US010131176B2

(12) United States Patent
Thurnherr

(10) Patent No.: US 10,131,176 B2
(45) Date of Patent: Nov. 20, 2018

(54) DEVICE AND METHOD FOR PRODUCING BOUND BOOK BLOCKS COMPRISING A LINING STRIP OR A COVER

(75) Inventor: Martin Thurnherr, Nebikon (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 392 days.

(21) Appl. No.: 13/457,626

(22) Filed: Apr. 27, 2012

(65) Prior Publication Data

US 2012/0275880 A1 Nov. 1, 2012

(30) Foreign Application Priority Data

Apr. 29, 2011 (CH) ..... 0739/11

(51) Int. Cl.

| | |
|---|---|
| ***B42C 9/00*** | (2006.01) |
| ***B42C 13/00*** | (2006.01) |
| ***B42C 11/02*** | (2006.01) |
| ***B42B 9/00*** | (2006.01) |
| ***B42C 11/04*** | (2006.01) |
| ***B42C 5/00*** | (2006.01) |
| ***B42C 5/02*** | (2006.01) |
| ***B42B 5/00*** | (2006.01) |
| ***B42B 5/06*** | (2006.01) |
| ***B42D 9/00*** | (2006.01) |
| ***B65H 5/26*** | (2006.01) |

(52) U.S. Cl.

CPC ..... *B42D 9/008* (2013.01); *B42C 11/04* (2013.01); *B65H 5/26* (2013.01)

(58) Field of Classification Search

CPC ..... B42C 9/00; B42C 13/00; B42C 11/02; B42C 11/04; B42C 5/00; B42C 5/02; B42B 9/00; B42B 5/06

USPC .... 412/9, 14, 16, 19, 20, 21, 22, 24, 30, 33, 412/34, 37, 900, 901, 902

See application file for complete search history.

(56) References Cited

U.S. PATENT DOCUMENTS

| | | | | |
|---|---|---|---|---|
| 4,556,353 A * | 12/1985 | Ehlermann | ..... | B42C 9/02 412/19 |
| 6,406,244 B1 * | 6/2002 | Le Riche | ..... | B42D 5/003 281/5 |
| 2003/0185654 A1 | 10/2003 | Rathert | | |

(Continued)

FOREIGN PATENT DOCUMENTS

| | | |
|---|---|---|
| DE | 10005493 A1 | 9/2001 |
| EP | 1344665 A1 | 9/2003 |
| EP | 2113392 A1 | 11/2009 |

*Primary Examiner* — Justin V Lewis

(74) *Attorney, Agent, or Firm* — Leydig, Voit & Mayer, Ltd.

(57) ABSTRACT

A device for producing a bound book block including a lining strip or a cover includes a pressing station configured to move the lining strip or the cover in a pressing direction from a position from which the lining strip or the cover is gluable to a spine of the book block and to press the lining strip or the cover against the spine of the book block. A lining supply and a cover supply are each disposed upstream of the pressing station. A linearly movable common transport means is connected to the pressing station and configured to selectively, successively transfer the lining strip or the cover into the pressing station in a conveying direction and to convey the lining strip or the cover in the pressing station relative to the book block into a second position.

9 Claims, 3 Drawing Sheets

(56) References Cited

U.S. PATENT DOCUMENTS

| | | | | |
|---|---|---|---|---|
| 2006/0182520 | A1* | 8/2006 | Shibuya | B42C 11/04 412/8 |
| 2007/0031212 | A1* | 2/2007 | Albrecht | B42C 9/02 412/9 |
| 2009/0274536 | A1 | 11/2009 | Silberbauer | |
| 2011/0255939 | A1* | 10/2011 | Winkelmann | B42C 11/02 412/33 |
| 2011/0262248 | A1* | 10/2011 | De Marco | B42C 9/02 412/33 |

* cited by examiner

DEVICE AND METHOD FOR PRODUCING BOUND BOOK BLOCKS COMPRISING A LINING STRIP OR A COVER

CROSS-REFERENCE TO PRIOR APPLICATION

Priority is claimed to Swiss Patent Application No. CH 00739/11, filed on Apr. 29, 2011, the entire disclosure of which is hereby incorporated by reference herein.

FIELD

The invention relates to a device and a method for producing bound book blocks.

BACKGROUND

In perfect binding, single sheets and/or folded signatures previously assembled to form a loose book block are processed at the spine thereof by routing and glue is then applied thereto. A cover is then pressed against the spine of the book block and thereby rigidly glued thereto. A distinction is made between the production of printed products having a flexible cover and those having a rigid cover (hard cover), that is to say between what are known as soft-cover and hard-cover products.

When binding a soft-cover book, the spine of the loose book block is firstly routed and glue is then applied to the spine before the cover is applied. The book bound in this manner can then be cut to the desired size in a three-knife trimmer.

In hard-cover production, the loose book block is generally provided, after routing, with what are known as endsheets, which are glued to the two sides of the book block by a thin glue line. In the finished book, these endsheets serve as a hinge to the cover. A lining strip which consists of a woven material and overlaps the spine of the book block is then applied, that is to say, glued to the spine of the book block using a hotmelt glue or PUR, for example. The lining strip serves to reinforce the book block and holds it together. After the endsheet and the lining strip have been pressed on, the book block is provided with a rigid cover.

Alternatively, a sewn book block can also be glued to a rigid or a flexible cover.

Regardless of whether a soft-cover product or a hard-cover product is to be produced from a sewn or from a perfect-bound book, in conventional devices two steps must be carried out in order to apply the cover or the lining strip. The lining strip or the cover is firstly glued to the spine of the book block in a first station and then pressed against the book block in a second station.

European patent application EP1344655 A2 discloses a device for producing bound book blocks, in particular for short runs. The device comprises an endsheet feeding means and a feeding device for lining strips which cooperates with a cutting means. The lining strip is cut to size and then glued to the spine, to which glue has previously been applied, of the book block. The book block is then transported into a further processing station, whereupon side glue application takes place. As an alternative to feeding endsheets and lining strips for producing a hard-cover book, this device can also be used to feed a flexible cover for the purpose of producing a soft-cover book. In the further processing station, the lining strip, which has been glued to the spine of the book block, or the flexible cover is pressed against the book block in the spine region and in the side region. The pressing operation requires correspondingly formed additional devices, for example a pressing station.

DE10005493 A1 discloses a method and a device for feeding covers and/or lining strips to a perfect binder. In this solution, which has a low binding capacity and is also suitable only for short runs, the covers and/or lining strips, which are fed separately from one another, are taken up by means of a gripper drum and conveyed for rolling onto a book block moved by a transport means. In a solution of this type, transporting the covers on the surface of the gripper drum becomes increasingly difficult as the rigidity of the covers increases. In addition, the quality of the bound book block can be influenced negatively by relatively rigid covers being deformed on the surface of the gripper drum.

The devices for applying endsheets and lining strips used in the production of hard-cover products often require prolonged changeover times because these devices are located in the region of a book conduit which is used to transport the book block and can only be set to one product thickness in each case. In this context it must be ensured that the glue does not dry while the book block is being transported to the pressing station; for this reason the transport speed must be adapted to the glue used, for example dispersion glue, hotmelt glue or PUR. A device of this type also has relatively large space requirements. These aspects contribute to the fact that the perfect binder is firstly of an overall size which is problematic for the user and secondly relatively expensive.

SUMMARY

In an embodiment, the present invention provides a device for producing a bound book block including a lining strip or a cover. A pressing station is configured to move the lining strip or the cover in a pressing direction from a position from which the lining strip or the cover is gluable to a spine of the book block and to press the lining strip or the cover against the spine of the book block. A lining supply and a cover supply are each disposed upstream of the pressing station. A linearly movable common transport means is connected to the pressing station and configured to selectively, successively transfer the lining strip or the cover into the pressing station in a conveying direction that extends substantially perpendicular to the pressing direction and to convey the lining strip or the cover in the pressing station relative to the book block into the position from which the lining strip or the cover is gluable to the spine of the book block.

BRIEF DESCRIPTION OF THE DRAWINGS

The present invention will be described in even greater detail below based on the exemplary figures. The invention is not limited to the exemplary embodiments. Features described and/or represented in the various figures can be used alone or combined in embodiments of the present invention. Other features and advantages of various embodiments of the present invention will become apparent by reading the following detailed description with reference to the attached drawings which illustrate the following.

In the figures, like reference numerals denote structurally or functionally equivalent components.

DETAILED DESCRIPTION

Figure 1:
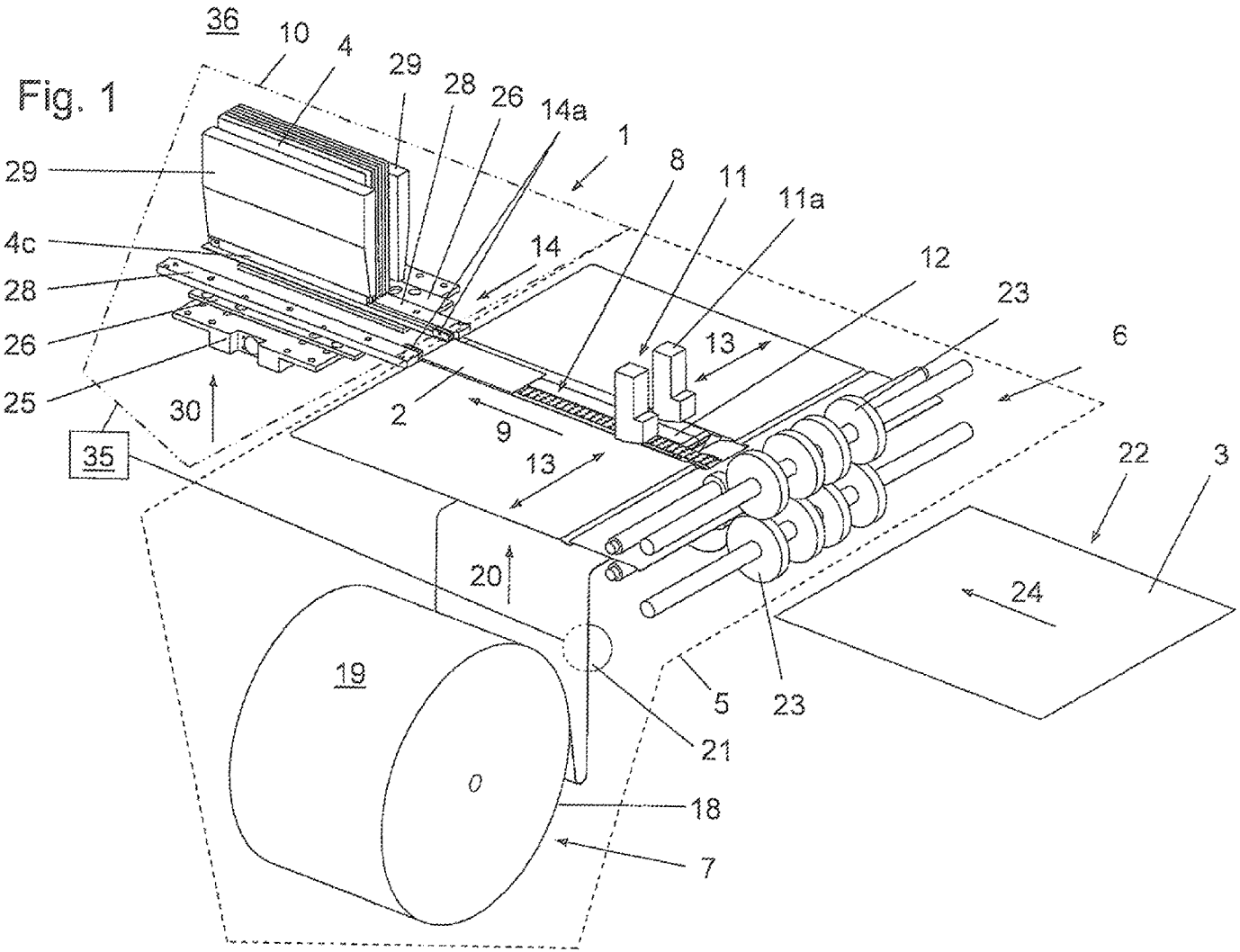
FIG. 1 is a view of a device according to an embodiment of the invention for producing bound book blocks.

The present invention recognizes that there is a need for compact and universal perfect binders which combine as many functions as possible in the smallest possible space.

In an embodiment, the invention provides a device and a method using which bound book blocks, which comprise a cover or a lining strip, depending on whether they are to be used for a soft-cover or a hard-cover product, can be produced cost-effectively, with low space requirements and with changeover times which are as short as possible. By this means, medium and very short runs down to a single book block are to be producible economically.

The device has a linearly movable common transport means, which is connected to the pressing station and has a conveying direction which extends substantially perpendicular to the pressing direction, for selectively successively transferring a lining strip or a cover into the pressing station and for conveying the lining strip or the cover in the pressing station relative to the book block into a position from which the lining strip or the cover can be glued to the spine of the book block. Accordingly, a lining strip or a cover is selectively successively transferred into the pressing station in a conveying direction which is substantially perpendicular to the pressing direction, moved linearly in the conveying direction in the pressing station and conveyed relative to the book block into a position from which the lining strip or the cover is glued to the spine of the book block.

Using the device according to embodiment of the invention, a lining strip or a cover is glued to and pressed against the book block in the pressing station, that is to say in a single device. By bringing together the gluing and pressing operations in this way, at least one transport path is dispensed with, as a result of which the space requirement and the costs associated therewith can be reduced. Finally, it is advantageously possible, without interrupting the method, to switch from production of a book block comprising a lining strip to production of a book block comprising a cover and vice versa.

After the lining strip or the cover has been applied to the book block, to which glue has been applied, the book block bound in this manner is ejected from the device according to embodiment of the invention and fed to a further processing system, for example a three-knife trimmer, which cuts the book block to the required format in the front, head and foot regions.

In an embodiment of the invention, the transport means is formed such that it can be moved substantially horizontally, in such a way that the lining strip or the cover is advantageously conveyed substantially horizontally in the pressing station. In this way, a relatively simple and cost-effective transport means can be produced.

In a further embodiment of the invention, the transport means comprises at least one driven gripper and a guide for the at least one driven gripper, the lining strip or the cover being gripped by the gripper during the transfer into the pressing station, drawn into the pressing station and conveyed in the pressing station until it is flush with transverse edges of the spine of the associated book block.

According to a next embodiment of the invention, the pressing station comprises two lateral stops for guiding the lining strip or the cover on two sides, a gripper being arranged at each of the two lateral stops. In this way, the lining strip or the cover can be guided particularly effectively and uniformly in the pressing station.

According to a next embodiment of the invention, the pressing station comprises two side pressing faces, which are arranged mutually parallel at a distance from one another, and a lower pressing face, the side pressing faces being formed such that they can be moved towards one another for pressing the lining strip or the cover against the book block and the lower pressing face being formed such that it can be moved upwards.

During the application of the lining strip or the cover to the book block, said book block is clamped by a book clamp, which acts on the front and back thereof, and held in a fixed position. For the purpose of being glued to the spine of the book block, the lining strip or cover to which glue has previously been applied is moved towards the book block in a pressing direction which is substantially perpendicular to the conveying direction, until it rests against said book block. For this purpose, the lining strip or cover is located on the lower pressing face, arranged parallel to the spine of the book block, of the pressing station in a position flush with transverse edges of the spine of the associated book block. Immediately after the gluing operation, the lining strip or the cover is pressed against the spine of the book block by means of the lower pressing face and against the front and back of the book block by means of the two side pressing faces. The pressing operation, which takes place from three sides substantially simultaneously with the gluing operation, prevents the lining strip or the cover from shifting and ensures good compaction of the book block bound thereby.

In a further embodiment of the invention, a combined feeding station comprising a conveyor means for selectively feeding lining strips or covers is arranged between the pressing station on the one hand and the lining supply and the cover supply on the other hand. A lining strip or a cover can thus be fed selectively and successively to the pressing station in an uninterrupted manner.

The conveyor means comprises a vacuum belt which circulates over at least a driven first deflection roller and a second deflection roller and around a work plate of the combined feeding station and comprises means for drawing the lining strip or the cover onto the vacuum belt, in particular the lining supply being arranged below and the cover supply being arranged above the work plate and opening into the combined feeding station. Owing to this unification of the cover supply and the lining supply outside the pressing station, the device can be switched more dynamically from production of book blocks for soft-cover products to production of book blocks for hard-cover products and vice versa.

Finally, the device according to embodiment of the invention is used in a perfect binder. By saving transport members, the cost of the resulting production line can be reduced even when combining the device according to embodiment of the invention with the perfect binder. Ultimately, costs are saved even by accelerating the production process, since more efficient use can be made of the perfect binder.

FIG. 1 is a view of the device 1 according to embodiment of the invention, using which either a lining strip 2 or a cover 3 is applied to a loose book block 4. A book block 4 of this type basically consists of a number of signatures or single sheets which are to be bound at a spine 4*a* (FIG. 2, FIG. 3) of the book block 4. The device 1 has a combined feeding station 5 comprising a cover supply 6, a lining supply 7 and a conveyor means 8 for lining strips 2 or covers 3, and a pressing station 10 which is connected to the combined feeding station 5 in a conveying direction 9. The combined feeding station 5 is arranged between the pressing station 10 on the one hand and the lining supply 7 and the cover supply 6 on the other hand. FIG. 1 and FIG. 3 show the combined feeding station 5 and the components thereof by means of a dashed line, and the pressing station 10 and the components thereof by means of a dot-dash line.

The combined feeding station 5 also has a gluing unit 11 comprising at least one glue nozzle 11*a* for applying glue to the lining strip 2 or to the cover 3. In the exemplary embodiment of the device according to the invention shown in FIG. 1, the gluing unit 11 comprises two glue nozzles 11*a* for applying glue of the same type or of different types. Of course, it is also possible to provide more than two glue nozzles 11*a*.

The gluing unit 11 is arranged above a work plate 12 of the combined feeding station 5 so as to be movable transverse to a conveying direction 9 of the lining strip 2 or the cover 3 in the conveyor means 8. The glue nozzles 11*a* (shown only schematically) can be moved back and forth in a displacement direction 13, in such a way that the face to which glue is to be applied of the lining strip 2 or the cover 3 can be adjusted in a variable manner. This is particularly advantageous for adapting to different thicknesses of the book block 4 and to different types of lining strip 2 or cover 3. In a preferred embodiment, the gluing unit 11 is configured in such a way that it comprises a plurality of glue nozzles 11*a*, at least one suitable glue nozzle 11*a* being selectable according to the type of glue to be applied. For example, different glue nozzles 11*a* can be used for dispersion glue, hotmelt glue or PUR. A further degree of freedom in the use of glue nozzles 11*a* of this type is the type of glue application. Depending on the use, the glue can be sprayed on in lines or even over a large area, for which purpose correspondingly formed glue nozzles 11*a* are also necessary.

Depending on whether the device 1 is currently being used to produce bound book blocks 4 for hand-cover or soft-cover products, the conveyor means 8 of the combined feeding station 5 is used to feed lining strips 2 or covers 3 into the region of action of a linearly movable transport means 14 of the pressing station 10. The conveyor means 8 comprises a vacuum belt 16 which circulates over at least a first and a second deflection roller 15, 15*a* and around the work plate 12 (FIG. 2), and which has means 16*a* formed as openings (FIG. 3) for drawing the lining strip 2 or the cover 3 onto the vacuum belt 16. The deflection rollers 15, 15*a* are driven by a drive means. Of course, it is also possible for only one of the deflection rollers 15, 15*a* to be driven.

The lining strips 2 are fed to the combined feeding station 5 by means of the lining supply 7, arranged upstream, in which a lining tape 19 located on a roller 18 is firstly unrolled and conveyed in a feeding direction 20 to the combined feeding station 5. During this transport, the lining tape 19 is cut as needed to a length of the spine 4*a* of the corresponding book block 4 by a first cutting means 21 formed as a wheel. Of course, the lining tape can also be cut to length elsewhere in the combined feeding station 5 or upstream of the combined feeding station 5 and by another tool. The lining tape 19 is also cut basically to the width of the spine 4*a* of the book block 4, before the resulting lining strip 2 is taken up by a lower portion 16*b* of the vacuum belt 16 (FIG. 3). Depending on requirements, the lining strip 2 can also be wider than the spine 4*a* of the book block 4, in order also to enclose a front and back of the book block 4 in a region adjacent to the spine 4*a* thereof.

The cover supply 6 comprises a preferably external cover container 22, from which covers 3 are removed in succession and conveyed by means of guide rollers 23 in a feeding direction 24 to the combined feeding station 5. While the covers 3 are fed to the vacuum belt 16 from above the work plate 12, the lining strips 2 are fed from below the work plate 12.

The lining strips 2 or the covers 3 are taken up by the conveyor means 8 of the combined feeding station 5 and transported in the conveying direction 9 into the region of action of grippers 14*a* of the transport means 14 of the pressing station 10, in such a way that transverse edges of the respective lining strip 2 or the respective cover 3 are orientated transverse to the conveying direction 9 during the transport. Lining strips 2 or covers 3 are selectively successively fed to the pressing station 10 in an uninterrupted manner by the vacuum belt 16 of the conveyor means 8. Obviously, the conveyor means 8 can also be equipped with other transport members, for example with a clamp transporter.

The pressing station 10 comprises a mounting plate 25, two lateral pressing plates 26 which are arranged mutually parallel at a distance from one another and can be moved towards one another, a lower pressing plate 27 (FIG. 2), two lateral stops 28 and the common transport means 14 for lining strips 2 or covers 3, which in this case is equipped with two grippers 14*a* and can be moved linearly and in particular substantially horizontally. Said transport means is configured in such a way that it can selectively successively draw either a lining strip 2 or a cover 3 between the lateral stops 28 in the conveying direction 9 into the pressing station 10 until said lining strip or cover reaches a position in which it is flush with transverse edges 4*b* (FIG. 2, FIG. 3) of the spine 4*a* of the associated book block 4. The book block 4 is clamped by a book clamp 29 and held in a fixed position. The lining strip 2 or the cover 3 is then raised in a pressing direction 30 by means of the mounting plate 25, the lateral pressing plates 26, the lower pressing plate 27 and the lateral stops 28 and thereby glued to the spine 4*a*, that is to say to an overhang 4*c* of the book block 4 which includes the spine 4*a* and projects downwards out of the book clamp 29. After the gluing operation, the lining strip 2 or the cover 3 is pressed against the spine 4*a* by a further movement of the mounting plate 25 in the pressing direction and against the regions of the front and back of the book block 4 in the vicinity of the spine by means of the lateral pressing plates 26.

As already mentioned at the outset, it is usual in conventional production of bound book blocks firstly to glue the lining strip or the cover to the spine before the book block is conveyed to a separate pressing station in which the lining strip or the cover is pressed against the spine or the overhang of the book block.

In the device 1 according to embodiment of the invention, glue is applied to the lining strip 2 or the cover 3 in the combined feeding station 5. The lining strip 2 or cover 3 to which glue has been applied is then transported to the pressing station 10, arranged downstream in the conveying direction 9, where it is transferred in a common conveying direction 9 extending substantially perpendicular to the pressing direction 30 into the pressing station 10 and conveyed linearly and relative to the book block 4 in the pressing station 10 into a position from which the lining strip 2 or the cover 3 is glued to the spine 4*a* of the book block 4. For this purpose, the lining strip 2 or the cover 3 is glued to the spine 4*a* of the book block 4 in the pressing station 10 by means of the lower pressing plate 27 fitted on the mounting plate 25. Immediately thereafter the lining strip 2 or the cover 3 is pressed against the book block 4 by the same lower pressing plate 27 and by means of the lateral pressing plates 26, which are likewise fitted on the mounting plate 25. The glue located between the book block 4 and the lining strip 2 or the cover 3 is then set without further pressing. This happens either while the book block 4 is leaving the pressing station 10 and/or after it has already left said pressing station. In this connection, "gluing to" defines an operation in which the lining strip 2 or cover 3 is pressed against the spine 4*a* of the book block 4 only strongly enough for it to adhere thereto. In contrast thereto, "pressing against" the book block 4 in the spine region and in the lateral region thereof involves the exertion of a considerably greater pressure, in such a way that the lining strip 2 or the cover 3 subsequently holds together the book block 4, which previously consisted of loose signatures. In the device 1 according to embodiment of the invention, the gluing and pressing operations are merged and carried out in a single device, namely the pressing station 10. In other words, the lining strip 2 or the cover 3 is firstly glued to the book block 4 by the movement of the lower pressing plate 27 in the pressing direction 30 and then pressed against the book block 4 through increased exertion of pressure by the lower pressing plate 27 and substantially simultaneous exertion of pressure by means of the lateral pressing plates 26.

Figure 2:
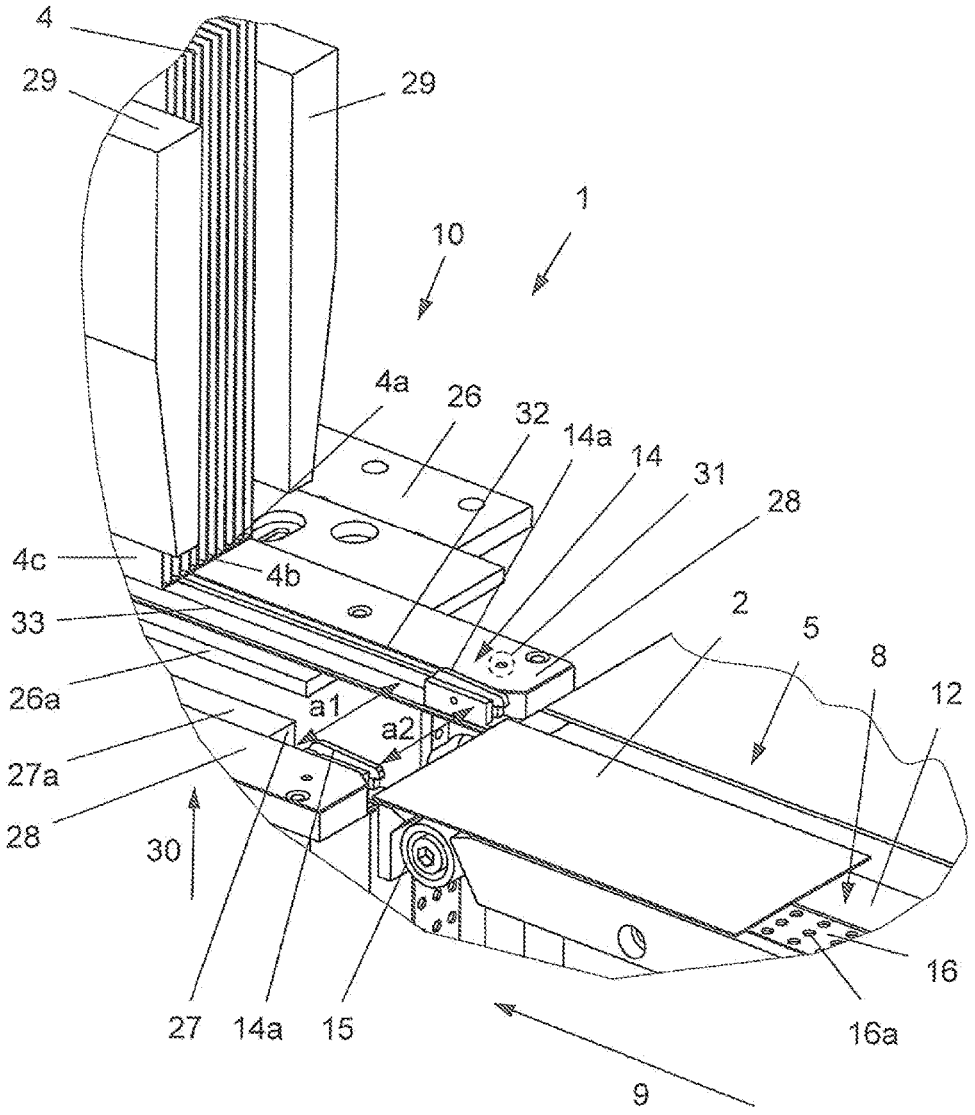
FIG. 2 is an enlarged detailed view of a feeding station and a pressing station of the device according to an embodiment of the invention.
Figure 3:
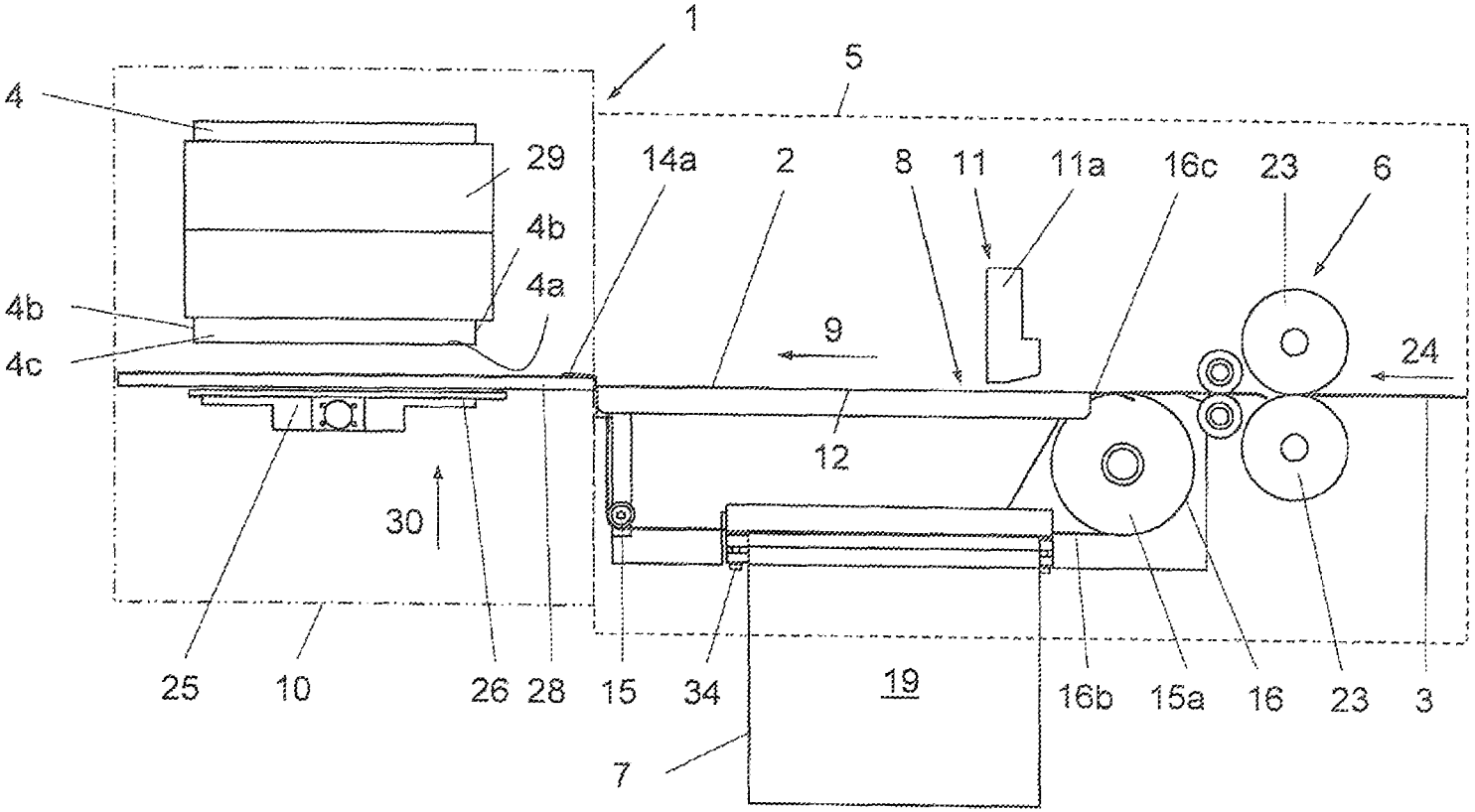
FIG. 3 is a side view of the device according to an embodiment of the invention.

FIG. 2 shows a detailed view of the combined feeding station 5 and the pressing station 10 of the device 1 according to embodiment of the invention for producing bound book blocks 4 comprising a lining strip 2 or a cover 3. As described in connection with FIG. 1, the lining strip 2 or the cover 3 is taken from the vacuum belt 16 of the combined feeding station 5 by the transport means 14 of the pressing station 10 and initially gripped by the grippers 14*a* of the transport means 14. For this purpose, the grippers 14*a* are preferably opened pneumatically against the resistance of a spring prior to the arrival of the lining strip 2 or cover 3 to be fed by the conveyor means 8, and close again under the effect of the spring after completion of the compressed air supply. The lining strip 2 or the cover 3 is then guided linearly between the lateral stops 28 in the conveying direction 9 by means of the grippers 14*a* into the pressing station 10 and drawn in until it is flush with the transverse edges 4*b* of the spine 4*a* of the book block 4, which meanwhile is held in the book clamp 29. The grippers 14*a* are moved a corresponding distance in the conveying direction 9 along a guide 33, formed as a planar face, by means of a drive member 32, which is connected to a drive and in this case is formed as a toothed belt circulating around belt pulleys 31. Of course, any other suitable guide 33 can also be used for the grippers 14*a*.

A distance a1 between the lateral stops 28 is adjusted by a first movement, transverse to the conveying direction 9 of the lining strip 2 or cover 3, of at least one of the lateral stops 28, in such a way that said distance basically corresponds to a width of the lining strip 2 or the cover 3. Similarly, a distance a2 between the grippers 14*a* of the transport means 14 is adjusted by a second movement, transverse to the conveying direction 9, of at least one of the grippers 14*a*.

In a preferred embodiment of the device 1 according to embodiment of the invention, each gripper 14*a* of the transport means 14 is fastened to an adjacent lateral stop 28, in such a way that the first and the second movement coincide. This advantageously means that only a single drive is required for the movement of the lateral stops 28 and of the grippers 14*a*.

The final position of the lateral stops 28 and of the transport means 14 in the case of the lateral movement, and a final position of the lining strip 2 or cover 3 in the pressing station 10 is monitored by sensors. In particular, the final position of the lining strip 2 or cover 3 can for example be delimited by a stop at the end of the guide 33. By positioning the book block 4 flush with a stop of this type, it is ensured by mechanical means that the lining strip 2 or cover 3 which has been drawn in is arranged in the pressing station 10 so as to be flush with the transverse edges 4*b* of the spine 4*a* of the book block 4. Servomotors, for example, can also be used to align the lining strip 2 or cover 3 and the book block 4 flush with one another.

Once positioning via the transport means 14 is complete, the lining strip 2 or the cover 3 is brought up to, glued to and pressed against the spine 4*a* of the book block 4, as described above. For this purpose, the lower pressing plate 27, which is arranged below the spine 4*a* and parallel thereto, is moved in the pressing direction 30 towards the spine 4*a* of the book block 4 and glues the lining strip 2 or cover 3 which is advanced in this manner to the spine 4*a* of the book block 4 from below by means of a pressing face 27*a* which can be moved upwards. The pressure of the lower pressing plate 27 against the spine 4*a* of the book block 4 is then increased, whereby the lining strip 2 or the cover 3 is pressed against the spine 4*a* of the book block 4. At the same time, the lateral pressing plates 26 are brought towards the two sides of the book block 4 and, by means of their side pressing faces 26*a*, press the lining strip 2 or cover 3 laterally against the overhang 4*c* of the book block 4. This simultaneous pressing from three sides prevents the lining strip 2 or the cover 3 from shifting and ensures good compaction of the book block 4 bound thereby.

The lower pressing plate 27 can adapt to the shape of the spine 4*a*, as a result of which the lining strip 2 or the cover 3 can be pressed uniformly against the book block 4. This configuration of the lower pressing plate 27 makes it possible to press lining strips 2 or covers 3 against a book block 4 with equal quality.

FIG. 3 is a side view of the device 1 according to embodiment of the invention and the combined feeding station 5. The components of the combined feeding station 5 are shown in the dashed rectangle and components of the pressing station 10 are shown in the dot-dash rectangle. In particular, this side view shows some of the parts of the combined feeding station 5 which provide the lining strips 2. The vacuum belt 16 of the conveyor means 8 circulates around the first and the second deflection roller 15, 15*a* in an endless loop. The lining tape 19 provided by the lining supply 7 is firstly optionally cut to the length of the spine 4*a* of the associated book block 4 by the first cutting means 21 shown in FIG. 1. An end of the lining tape 19 is then positioned below the lower portion 16*b* of the vacuum belt 16 and cut basically to the width of the book block 4 by a second cutting means 34 arranged below the work plate 12. The second cutting means 34 can obviously also be arranged to the side of the work plate 12. Afterwards the lining strip 2 which is produced in this manner and separated from the lining tape 19 is drawn in by the means 16*a*, formed as openings, of the lower portion 16*b* of the vacuum belt 16, and transported around the second deflection roller 15*a* onto an upper portion 16*c* of the vacuum belt 16 and from there in the conveying direction 9 to the pressing station 10.

In a preferred embodiment, the second cutting means 34 comprises a vertically movable blade which cuts a lining strip 2 from the lining tape 19, which rests against a cutting edge. In another preferred embodiment, the second cutting means 34 comprises a blade and a counter blade which cut the lining strip 2 from the lining tape 19 by means of a shear cut.

The lining strip 2 is preferably cut to the length and width required in accordance with the associated book block 4 prior to being fastened to the vacuum belt 16 of the conveyor means 8. For this purpose, the cutting means 21 and the pressing station 10 are connected to a corresponding control system 35 (FIG. 1), making it possible to cut the lining strip 2 to size individually according to the format of the book block 4 to be supplied and to transport the lining strip 2 accordingly in the pressing station 10.

After the lining strip 2 has been cut to size, it is drawn onto the lower portion 16*b* of the vacuum belt 16 and transported thereby below the work plate 12, counter to the conveying direction 9, towards the second deflection roller 15*a*. This deflection roller 15*a* deflects the lining strip 2 in the conveying direction 9 onto the upper portion 16*c* of the vacuum belt 16, before said lining strip is transported in the conveying direction 9 above the work plate 12 and brought into the region of action of the transport means 14 of the pressing station 10. As a result of this space-saving arrangement of the second cutting means 34, time is also saved. This advantage takes effect in particular when a cover 3 and a lining strip 2 are fed alternately to the pressing station 10. While the cover 3 is transported to the pressing station 10, the subsequent lining strip 2 can already be drawn onto the lower portion 16*b* of the vacuum belt 16 below the work plate 12 and set in movement towards the second deflection roller 15*a*.

The combined feeding station 5 and the pressing station 10 can be used together with the lining supply 7, the cover supply 6 and a removal unit 36 (FIG. 1) for book blocks 4 provided with a lining strip 2 or a cover 3 in a perfect binder (in this case indicated merely by the book clamp 29).

Although advantageous embodiments of the invention have been shown and described, the invention is not limited thereto, but can be configured and used in other ways within the scope of the following claims.

The invention claimed is:

1. A device for producing a bound book block including a lining strip or a cover, the device comprising:

a pressing station configured to move the lining strip or the cover in a pressing direction from a position from which the lining strip or the cover is gluable to a spine of the book block and to press the lining strip or the cover against the spine of the book block;

a lining supply disposed upstream of the pressing station;

a cover supply disposed upstream of the pressing station; and a linearly movable common transporter connected to the pressing station and including at least one driven gripper configured to move in a conveying direction to selectively, successively transfer the lining strip or the cover into the pressing station such that the lining strip or the cover moves relative to the book block in the conveying direction into the position from which the lining strip or the cover is gluable to the spine of the book block, the conveying direction extending substantially perpendicularly to the pressing direction and the common transporter including a guide disposed so as to guide the at least one driven gripper, wherein the pressing station includes two side pressing faces disposed mutually parallel at a distance from one another, and a lower pressing face, the side pressing faces being movable towards one another so as to press the lining strip or the cover against the book block and the lower pressing face being movable upward.

2. The device according to claim 1, wherein the common transporter is configured to move substantially horizontally.

3. The device according to claim 1, wherein the pressing station includes two lateral stops configured to guide the lining strip or the cover on two sides and a gripper disposed at each of the two lateral stops.

4. The device according to claim 1, further comprising a combined feeding station including a conveyor for selectively feeding the lining strip or the cover disposed between the pressing station and the lining supply and the cover supply.

5. The device according to claim 1, wherein the lining supply includes at least one cutter for cutting the lining strip to a predetermined size.

6. The device according to claim 5, wherein the cutter and the pressing station are connected to a control system configured to individually determine the predetermined size based on a format of the book block to be supplied and to control transport of the lining strip.

7. A device for producing a bound book block including a lining strip or a cover, the device comprising:

a pressing station configured to move the lining strip or the cover in a pressing direction from a position from which the lining strip or the cover is gluable to a spine of the book block and to press the lining strip or the cover against the spine of the book block;

a lining supply disposed upstream of the pressing station;

a cover supply disposed upstream of the pressing station;

a linearly movable common transporter connected to the pressing station and including at least one driven gripper configured to move in a conveying direction to selectively, successively transfer the lining strip or the cover into the pressing station such that the lining strip or the cover moves relative to the book block in the conveying direction into the position from which the lining strip or the cover is gluable to the spine of the book block, the conveying direction extending substantially perpendicularly to the pressing direction and the common transporter including a guide disposed so as to guide the at least one driven gripper; and a combined feeding station including a conveyor for selectively feeding the lining strip or the cover disposed between the pressing station and the lining supply and the cover supply, wherein the conveyor includes a vacuum belt circulating over at least a driven first deflection roller and a second deflection roller and around a work plate of the combined feeding station, the lining supply being disposed below and the cover supply being disposed above the work plate, each of the lining supply and the cover supply opening into the combined feeding station, the conveyor including openings for drawing the lining strip or the cover onto the vacuum belt.

8. The device according to claim 4, wherein the combined feeding station includes a gluing unit configured to apply glue to the lining strip or the cover, the gluing unit being movable transverse to the conveying direction of the lining strip or the cover in the conveyor.

9. The device according to claim 8, wherein the gluing unit includes at least one glue nozzle.

* * * * *